United States Patent [19]

Millet et al.

[11] Patent Number: 5,004,527

[45] Date of Patent: Apr. 2, 1991

[54] CONTINUOUS ELECTROLYTIC PRODUCTION OF ALKALI METAL PERCHLORATES

[75] Inventors: Jean-Christophe Millet, Saint-Genis-Laval; Michel Jaccaud, Lyons, both of France

[73] Assignee: Atochem, Puteaux, France

[21] Appl. No.: 435,289

[22] Filed: Nov. 9, 1989

[30] Foreign Application Priority Data

Nov. 9, 1988 [FR] France ..... 88 15137

[51] Int. Cl.[5] ..... C25B 1/26; C25B 1/28

[52] U.S. Cl. ..... 204/82; 204/95

[58] Field of Search ..... 204/82, 95

[56] References Cited

U.S. PATENT DOCUMENTS

| | | | |
|---|---|---|---|
| 2,512,973 | 6/1950 | Schumacher | 204/82 |
| 3,475,301 | 10/1969 | Cook, Jr. et al | 204/82 |
| 3,518,173 | 6/1970 | Crane | 204/82 |
| 3,518,180 | 6/1970 | Grotheer | 204/95 |
| 4,144,144 | 3/1979 | Radimer et al. | 204/82 |
| 4,267,025 | 5/1981 | de Nora et al. | 204/82 |

OTHER PUBLICATIONS

Pascal, "New Treatise on Inorganic Chemistry", vol. II, No. 1, (1966), p. 353 and FIG. 37.

*Primary Examiner*—T. Tung
*Assistant Examiner*—David G. Ryser
*Attorney, Agent, or Firm*—Burns, Doane, Swecker & Mathis

[57] ABSTRACT

The alkali metal perchlorates, e.g., sodium perchlorate or hydrate thereof, are continuously produced by continuously electrolyzing an aqueous solution electrolyte of a corresponding alkali metal chlorate in a single stage, while maintaining such electrolyte homogeneous and compositionally uniform over time by the continuous and simultaneous introduction of alkali metal chlorate and water thereto, and continuously directly separating desired alkali metal perchlorate from such solution of electrolysis.

15 Claims, No Drawings

CONTINUOUS ELECTROLYTIC PRODUCTION OF ALKALI METAL PERCHLORATES

BACKGROUND OF THE INVENTION

1. Field of the Invention

The present invention relates to a continuous process for the preparation of alkali metal perchlorates and, more especially, to the preparation of such perchlorates by electrolysis of aqueous solutions of the chlorates of such alkali metals.

Hereinafter, unless otherwise indicated, the chlorate of the alkali metal and the perchlorate of the alkali metal shall be referred to, respectively, as the "chlorate" and the "perchlorate".

2. Description of the Prior Art

The advantage of continuously preparing the alkali metal perchlorates is described, for example, in FR 1,402,590, and in U.S. Pat. Nos. 3,518,173, 3,518,180 and 3,475,301, and BR 125,608.

Such technique entails electrolyzing the chlorate in a succession of individual stages, each being different from and a tributary of another and providing only partial electrolysis relative to the intended final industrial result.

Therefore, to date an aqueous solution of perchlorate has been produced by the electrolysis of the chlorate, such that the perchlorate can be separated directly by crystallization, for example by cooling or by the evaporation of water therefrom.

It is known to this art that the electrolysis of the chlorate in a single stage does not produce such a solution as prepared under the practical conditions described, for example, in U.S. Pat. No. 2,512,973.

Conducting the operation in a large number of individual stages, in contrast is recommended, for example, in U.S. Pat. No. 3,475,301.

In a plural-stage process, commonly designated "in cascade", the total electrolytic equilibrium is disturbed by the electrolytic inbalance of a single stage and cannot be re-established simply by discontinuation of the "defective" stage.

SUMMARY OF THE INVENTION

Accordingly, a major object of the present invention is the provision of a single stage continuous process for the preparation of the alkali metal perchlorates which conspicuously avoids the disadvantages and drawbacks to date characterizing the state of this art and which yields a perchlorate solution which can be crystallized directly into a solid perchlorate having a high degree of purity.

As utilized herein, by "electrolytic stage" or "electrolysis stage" are intended the complete electrolysis operation and the product resulting therefrom or recycled thereto.

By "electrolyte" is intended the liquid to which, in the electrolysis operation, certain electrical conditions are applied, making it possible to convert the chlorate to perchlorate, and which contains the two compounds in the dissolved state.

By "perchlorate solution" from which the perchlorate can be separated directly by crystallization is intended a solution from which is deposited, by the evaporation of water or by cooling, solid perchlorate in the form of the monohydrate, dihydrate or anhydrous compound; see in this regard the text by Paul Pascal, New Treatise on Inorganic Chemistry. Vol. II, No. 1, p. 353 and FIG. 37 (1966), which reports the ternary $NaClO_4/NaClO_3/H_2O$ diagram.

Briefly, the present invention features a continuous process for the preparation of an alkali metal perchlorate by the electrolysis of an aqueous solution of alkali metal chlorate in a single electrolytic stage, wherein the electrolyte is compositionally uniform and homogeneous over time, such composition comprising an aqueous solution of perchlorate from which the perchlorate may be separated directly by crystallization and maintained by the continuous simultaneous introduction of chlorate and water thereto, in equal quantities, respectively, of the chlorate and the water which are continuously withdrawn from the electrolytic stage. The rechlorate, or hydrate thereof, is continuously recovered from such stage.

DETAILED DESCRIPTION OF THE PREFERRED EMBODIMENTS OF THE INVENTION

More particularly according to the present invention, the following definitions are utilized herein:

"uniform electrolyte": an electrolyte which remains the same at all points in the operation, relative in particular to its composition, its pH, its temperature;

"homogeneous composition": a constant composition stable over time.

The electrolyte is uniform by virtue of its agitation due, for example, by the release of gases in the electrolysis, optionally combined with an external recirculation thereto, for example by means of a pump.

The electrolyte, the composition of which is the same as that of the aqueous perchlorate solution emanating from the single electrolysis stage, comprises, in the case of the electrolysis of sodium chlorate to sodium perchlorate, preferably at least 100 g chlorate per liter, to obtain a FARADAY yield in excess of 90%.

The concentration of the electrolyte in chlorate and perchlorate, respectively, is constant over time, making it possible to avoid an increase in voltage at the electrode terminals.

The energy consumption per ton of the perchlorate ultimately produced is less than that of the known processes.

The electrolysis is carried out in any known apparatus, such as, for example, in a cell devoid of compartments and provided with monopolar electrodes, e.g., a platinum anode, such as, for example, a solid platinum sheet or platinum deposited onto a conducting substrate, and a cathode, for example of steel or bronze.

The electrical conditions observed are those permitting the conversion of chlorate into perchlorate, for example, for sodium perchlorate, an anodic current density ranging from 10 to 70 $A/dm^2$, typically on the order of 40 $A/dm^2$.

The pH of the electrolyte may vary over rather wide limits, for example from about 6 to 10. It is provided by means, for example, of perchloric acid or as alkali metal hydroxide, such as sodium hydroxide in the case of the electrolysis of sodium chlorate.

The amount of water introduced into the single electrolysis stage is an important parameter of the process of the invention and is introduced, for example, together with the aforementioned compounds or with other possible constituents of the electrolyte, such as sodium bichromate (the latter most typically being added in a proportion of about 1 g to 5 g per liter of the electrolyte in the case of the electrolysis of sodium chlorate).

The same is true relative to the water introduced into the single electrolysis stage and originating in the crystallization of the aqueous solution exiting from said stage: condensate of the water evaporated from said solution, mother liquor and wash water of the solid perchlorate produced.

The temperature of the electrolysis typically ranges from about 40° to 90° C. Heat exchange means, which may be internal or external relative to the electrolyte, make it possible to maintain the selected value of temperature.

The simultaneous and continuous addition of the chlorate and the water introduced into the single electrolysis stage may be carried out by introducing into said stage an aqueous chlorate solution containing all of the chlorate and all of the water required according to the invention. The concentration of the chlorate solution may be very high, for example 900 g of sodium chlorate per liter, to form the solution at an elevated temperature, for example 80° C.

The relative amounts of chlorate and water, such as those indicated above, may also be provided by adding the chlorate and the water separately, the chlorate being added in the solid state. In this case, the external recirculation in the single electrolysis stage may serve as the inlet chlorate.

A portion of the chlorate may be added in the solid state and the complementary fraction introduced in the form of an aqueous solution, for example in the form of an aqueous solution containing 700 g of chlorate per liter, constituted at 20° C.

The process according to the invention makes it possible to retain the advantage relative to the reduced consumption of platinum referred to in U.S. Pat. No. 3,475,301.

The perchlorate which constitutes the desired final product is separated in an essentially pure form, directly by the crystallization of the aqueous perchlorate solution as it exits the single electrolysis stage of the invention. In the case of the preparation of sodium perchlorate, the product particularly desired by industry is sodium perchlorate monohydrate, rather than anhydrous perchlorate or perchlorate dihydrate, the preparation of which is also possible according to the invention, depending on the composition of the electrolyte introduced.

In order to further illustrate the present invention and the advantages thereof, the following specific examples are given, it being understood that same are intended only as illustrative and in nowise limitative.

EXAMPLE 1

In this example, sodium perchlorate was prepared by the electrolysis of sodium chlorate in an apparatus essentially comprising an electrolytic cell having an external recirculation loop, the assembly defining the single electrolytic stage and comprising heat exchange, temperature measurement and control and pH control means. The electrolytic cell was not compartmentalized and was equipped with monopolar electrodes, platinum anodes and mild steel cathodes, traversed by an electric current, such that the anode current density was equal to 40 A/dm$^2$. The release of gases in the cell and the sufficiently large recirculation insured the uniformity of the electrolyte in said cell.

Initially, an electrolyte was formed in the cell, either directly from its components, or already by the progressive electrolysis of sodium chlorate, said electrolyte comprising an aqueous solution of sodium chlorate and sodium perchlorate in the presence of a small amount of sodium bichromate, from which the sodium perchlorate may be directly separated by crystallization.

In the present example, the electrolyte contained, per 100 g of water, 26 g sodium chlorate, 180 g sodium perchlorate and 0.3 g sodium bichromate.

The composition of the electrolyte established in this fashion was maintained stable over time by continuously introducing into the single electrolysis stage, 96 cm$^3$/h.dm$^2$ anode of a solution of sodium chlorate at 80° C. containing, per liter, 900 g sodium chlorate, 1.5 g sodium bichromate and the amount of perchloric acid required to provide a pH of the electrolyte, at 65° C., equal to 6.5. 85 cm$^3$/h.dm$^2$ anode of an aqueous solution, which according to the invention exhibited the composition of the electrolyte, continuously exited the single electrolysis stage, thus permitting direct separation by crystallization of the sodium perchlorate monohydrate, i.e., the desired final product.

EXAMPLE 2

This example was carried out in the apparatus of and according to the process of Example 1. The electrolysis was carried out, in particular, at the same temperature and pH as in Example 1. In this instance, the electrolyte contained, per 100 g of water, 36 g sodium chlorate, 220 g sodium perchlorate and 0.3 g sodium bichromate. This composition was maintained stable over time by continuously introducing into the single electrolysis stage, 46 g/h.dm$^2$ anode of solid sodium chlorate by means of the recirculation flowstream, and 84 cm$^3$/h.dm$^2$ anode, of an aqueous solution, at 20° C., containing, per liter, 500 g sodium chlorate, 1.5 g sodium bichromate and the amount of perchloric acid required to provide in the electrolyte a pH of 6.5. 76 cm$^3$/h.dm$^2$ anode of the aqueous perchlorate solution were recovered from the single electrolysis stage, from which the sodium perchlorate monohydrate was directly recovered by crystallization.

EXAMPLE 3

This example was also carried out in the apparatus and by the process of Example 1. The electrolysis was carried out at the same temperature and pH as in Example 1.

The electrolyte, the composition of which was that of the aqueous perchlorate solution from which the sodium perchlorate produced may be directly separated by crystallization, contained, per 100 g water, 30 g sodium chlorate and 290 g sodium perchlorate, in addition to 0.3 g sodium bichromate.

The electrolyte was maintained stable at this composition over time, by continuously introducing into the single electrolysis stage, 45 g/h.dm$^2$ anode of solid sodium chlorate by means of the recirculation flowstream and 74 cm$^3$/h.dm$^2$ anode of the aqueous sodium chlorate solution of Example 2, while 66 cm$^3$/h.dm$^2$ anode of an aqueous solution having the same composition as the electrolyte (and from which the perchlorate produced may be directly separated in the anhydrous state by crystallization) exited the single electrolysis stage.

The FARADAY yield, expressed as the ratio of the amount of electricity effectively used for the conversion of the chlorate into the perchlorate, over a given period of time, to the total amount of electricity consumed in the same period of time, was greater than 90% for the three examples described above. It was more than 93%, even in the absence of sodium bichromate, by repeating Example 1, but using an electrolysis temperature of 55° C. instead of 65° C.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the continuous production of an alkali metal perchlorate, comprising continuously electrolyzing an aqueous solution electrolyte of a corresponding alkali metal chlorate in a single electrolytic stage with a platinum anode, while maintaining said electrolyte homogeneous and compositionally uniform over time by the continuous and simultaneous introduction of alkali metal chlorate and water thereto in equal quantities to the chlorate and the water which are continuously withdrawn from the single electrolytic stage, wherein the composition of the electrolyte is such that alkali metal perchlorate can be directly separated therefrom by crystallization, and continuously directly separating desired alkali metal perchlorate from such solution of electrolysis.

2. The process as defined by claim 1, further comprising crystallizing perchlorate solids from such solution of electrolysis.

3. The process as defined by claim 1, comprising maintaining the electrolyte homogeneous and compositionally uniform by continuously introducing an aqueous solution of alkali metal chlorate thereto.

4. The process as defined by claim 1, comprising introducing solid alkali metal chlorate into said electrolyte.

5. The process as defined by claim 1, comprising introducing both solid alkali metal chlorate and an aqueous solution thereof into said electrolyte.

6. The process as defined by claim 1, wherein the alkali metal chlorate comprises sodium chlorate and the process continuously produces sodium perchlorate.

7. The process as defined by claim 6, comprising continuously producing sodium perchlorate monohydrate.

8. The process as defined by claim 6, comprising continuously producing sodium perchlorate dihydrate.

9. The process as defined by claim 6, said electrolyte comprising at least 100 g sodium chlorate per liter thereof.

10. The process as defined by claim 1, carried out in an uncompartmentalized electrolytic cell provided with monopolar electrodes.

11. The process as defined by claim 10, said electrolytic cell further comprising a soft steel or bronze cathode.

12. The process as defined by claim 10, carried out employing an anodic current density ranging from 10 to 70 $A/dm^2$, at a temperature ranging from 40° to 90° C. and at a pH ranging from 6 to 10.

13. The process as defined by claim 1, comprising recycling water from such separated solution of electrolysis into said electrolyte.

14. The process as defined by claim 1, said electrolyte comprising from 1 to 5 g of sodium bichromate per liter thereof.

15. The process as defined by claim 1, said electrolyte comprising an aqueous solution of sodium chlorate, sodium perchlorate, and a minor amount of sodium bichromate.

* * * * *